US007465123B2

(12) United States Patent
Bergman

(10) Patent No.: US 7,465,123 B2
(45) Date of Patent: Dec. 16, 2008

(54) WATER CIRCULATION APPARATUS TO REDUCE EVAPORATION

(76) Inventor: Carla E. Bergman, 7413 NW. Autumn St., Kansas City, MO (US) 64152

( * ) Notice: Subject to any disclaimer, the term of this patent is extended or adjusted under 35 U.S.C. 154(b) by 188 days.

(21) Appl. No.: 11/327,692

(22) Filed: Jan. 6, 2006

(65) Prior Publication Data

US 2007/0160425 A1 Jul. 12, 2007

(51) Int. Cl.
*E03B 11/00* (2006.01)
*F03B 5/00* (2006.01)

(52) U.S. Cl. ..... 405/80; 210/170.01; 210/170.05

(58) Field of Classification Search ..... 405/52, 405/80; 210/170.01, 170.05, 170.09
See application file for complete search history.

(56) References Cited

U.S. PATENT DOCUMENTS

| | | | | |
|---|---|---|---|---|
| 2,878,098 | A | 3/1959 | Treloar et al. | |
| 3,320,160 | A | 5/1967 | Welles, Jr. et al. | |
| 3,452,966 | A * | 7/1969 | Smolski | 261/77 |
| 3,497,185 | A * | 2/1970 | Dively | 261/36.1 |
| 3,622,074 | A * | 11/1971 | Frohwerk | 239/11 |
| 3,935,156 | A | 1/1976 | Richter | |
| 4,030,859 | A | 6/1977 | Henegar | |
| 4,085,171 | A | 4/1978 | Baker et al. | |
| 4,089,620 | A * | 5/1978 | Ravitts | 417/61 |
| 4,302,162 | A | 11/1981 | Springston | |
| 4,669,914 | A * | 6/1987 | Kortmann | 405/52 |
| 4,762,276 | A | 8/1988 | Foust | |
| 4,764,313 | A | 8/1988 | Cameron et al. | |
| 4,865,725 | A * | 9/1989 | Metais | 210/136 |
| 5,524,393 | A * | 6/1996 | Nill et al. | 52/11 |
| 5,549,828 | A * | 8/1996 | Ehrlich | 210/602 |
| 6,231,268 | B1 | 5/2001 | Hausenbauer | |
| 6,432,302 | B1 | 8/2002 | Obritsch et al. | |
| 6,439,853 | B2 | 8/2002 | Tormaschy et al. | |
| 6,533,496 | B1 * | 3/2003 | Elliott | 405/80 |

OTHER PUBLICATIONS

Veissman, Warren Jr.; Knapp, John W.; Lewis, Gary L.; Harbaugh, Terence E., "Introduction to Hydrology, 2nd Edition," 1977, pp. 49-51, Harper and Row Publishers, Inc., New York.
Vennard, John K. & Street, Robert L., "Elementary Fluid Mechanics, Sixth Edition," 1982, p. 663, John Wiley & Sons, New York.
Ingersoll-Rand Company, "Cameron Hydraulic Data," 1984, pp. 3-32, 3-115, 3-116 and 3-118, Ingersoll-Rand Company, Woodcliff Lake, New Jersey.

* cited by examiner

*Primary Examiner*—Tara L. Mayo
(74) *Attorney, Agent, or Firm*—Erickson, Kernell, Derusseau & Kleypas, LLC

(57) ABSTRACT

A natural water circulation apparatus reduces the evaporation rate of a body of water by lowering the surface temperature and improves the quality of the water. The apparatus includes a collector which extends above the normal surface level of the water to capture surface waves. The captured water is conveyed from the epilimnion of the body of water to the hypolimnion of the body of water through a lower opening in the collector.

24 Claims, 3 Drawing Sheets

WATER CIRCULATION APPARATUS TO REDUCE EVAPORATION

BACKGROUND OF THE INVENTION

The present invention relates to an apparatus to circulate water and, more particularly, to an apparatus to circulate the water in a large body of water from the bottom to the surface to cool the surface of the water to reduce evaporation and improve the quality of the water.

Water evaporation from reservoirs results in a significant loss of an increasingly scarce resource and a revenue loss for water utilities. Evaporation losses may amount to thirty to forty percent of firm yields of reservoirs. Various devices and systems have been proposed to improve the circulation and quality of the water. However, these systems are often complex, expensive and require an external power source.

SUMMARY

The present invention provides a natural circulation apparatus to reduce evaporation and to enhance water quality of surface water reservoirs. The energy provided by waves generated through wind provides the hydraulic head for natural circulation of water from the epilimnion to the hypolimnion through this circulation apparatus. The warm surface water in the epilimnion is conveyed through a concentric apparatus to the lower water temperatures in the hypolimnion by the wave energy. As a result, the temperature of the surface water of a reservoir is reduced by allowing warmer water at the surface of the reservoir to be conveyed to the colder water temperature and the warm water and cold water are mixed together allowing the overall water temperature in a reservoir to equalize and the water temperature at the surface of the reservoir to decrease during warm weather months. The natural circulation lowers the surface water temperature of the reservoir to reduce evaporation and enhance water quality by destratifying the reservoir.

DETAILED DESCRIPTION

Figure 1:
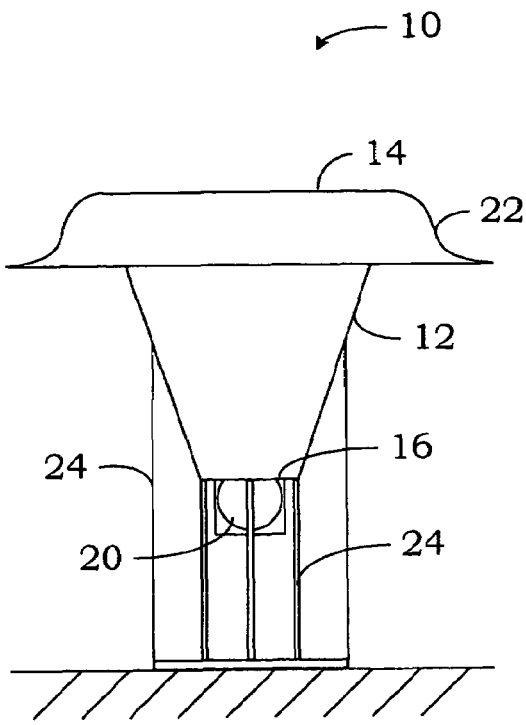
FIG. 1 is a side elevational view of the natural circulation apparatus of the present invention.
Figure 2:
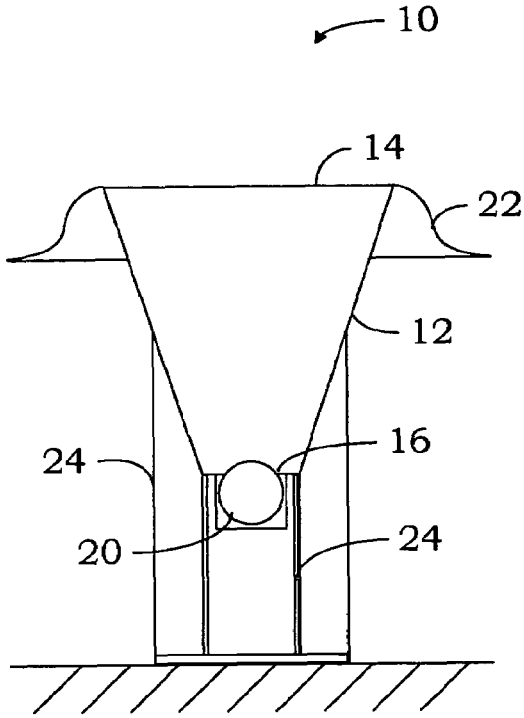
FIG. 2 is a sectional side elevational view of the natural circulation apparatus of FIG. 1.
Figure 3:
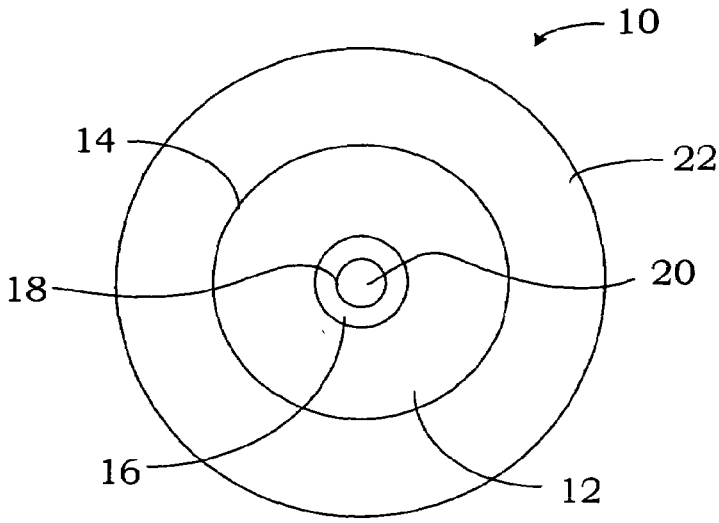
FIG. 3 is a top plan view of the natural circulation apparatus of FIG. 1.

Referring initially to FIGS. 1-3, a natural circulation apparatus for circulating water is generally indicated by reference numeral 10. Circulation apparatus 10 includes a generally frustro-conical collector 12 with an upper lip 14 and a lower water outlet 16. A check valve 18 is secured to the lower water outlet 16 to prevent water from flowing up into the collector 12 through the outlet 16. Check valve 18 may be normally closed with a buoyant ball 20 seated in the valve or a normally open flap valve, or a light weight louver, for example (not shown), which closes when water flows from the outlet in the collector 12, for example.

A flange 22 may be secured around the upper lip 14 of the collector 12. One or more supports 24 are secured to the collector 12 to anchor the collector 12 to the bottom of the body of water. The supports 24 or the upper portion of the collector 12 may be adjustable to vary the height of the upper lip 14 of the collector 12.

Figure 4:
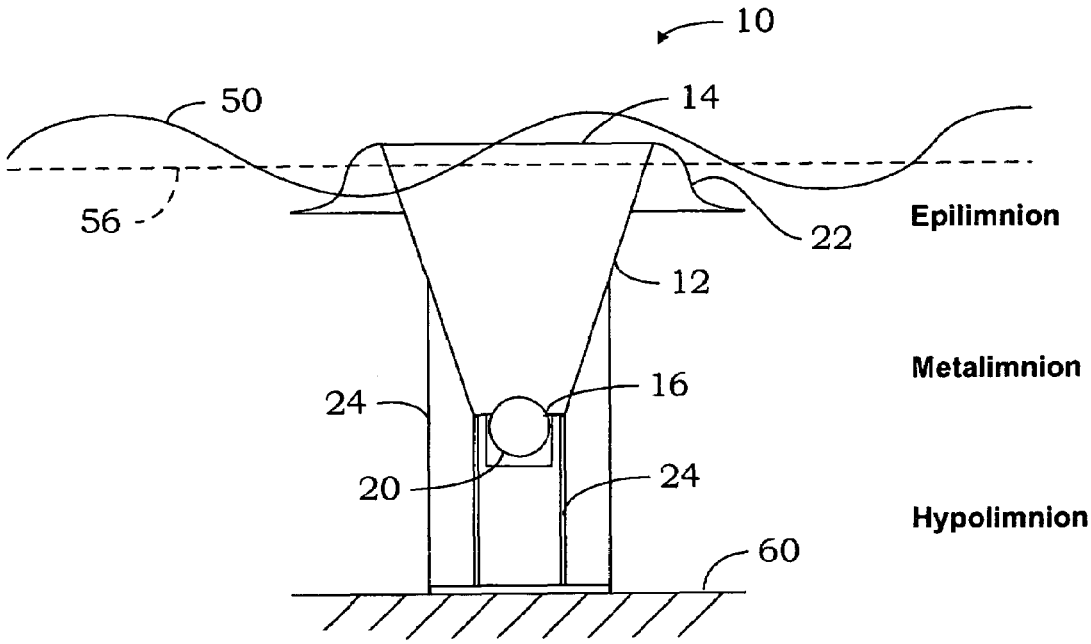
FIG. 4 is a sectional side elevational view of the natural circulation apparatus showing waves on the surface of a body of water.
Figure 5:
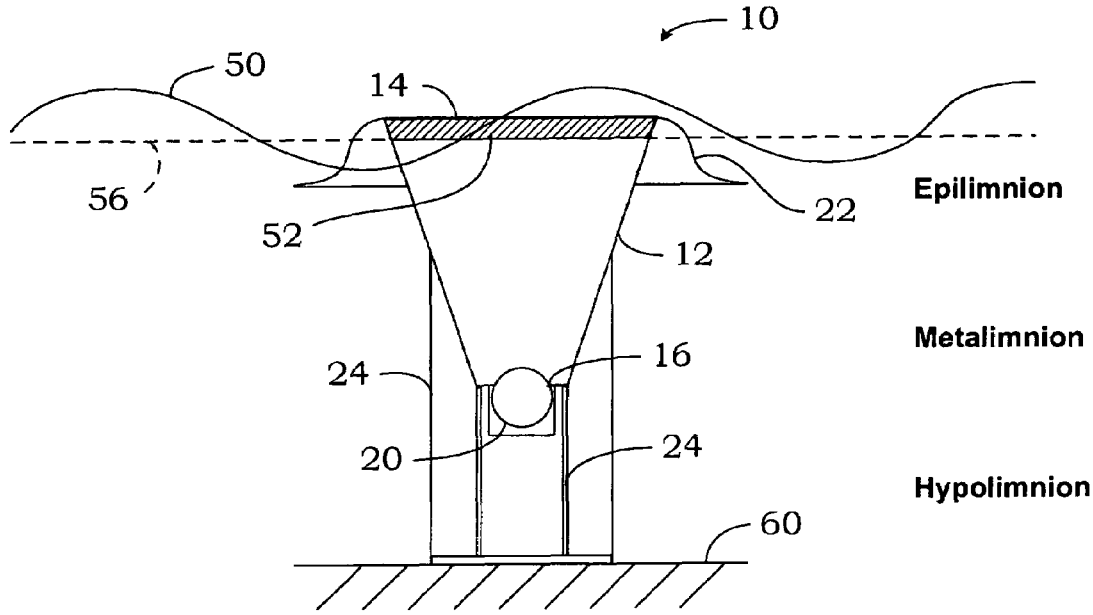
FIG. 5 is a sectional side elevational view of the natural circulation apparatus showing the volume of water collected from the surface of a body of water.
Figure 6:
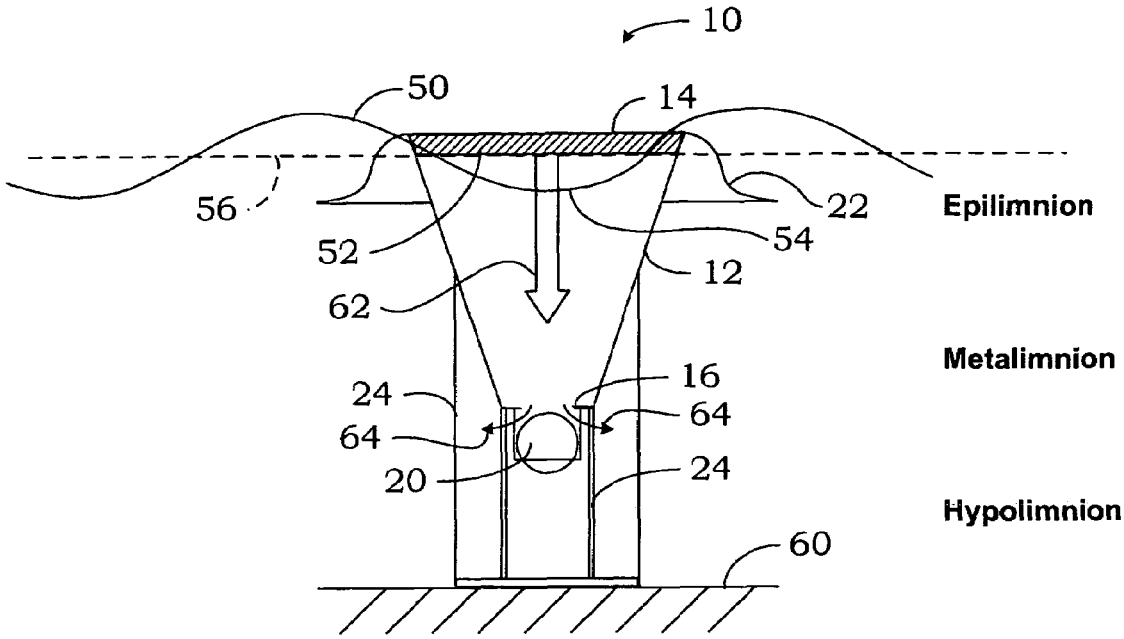
FIG. 6 is a sectional side elevational view of the natural circulation apparatus showing the volume of water collected from the surface of a body of water transferred to the bottom of the body of water.

Referring to FIGS. 4-6, the natural circulation apparatus 10 captures the wave energy as a wave 50 flows over the flange 22 and submerges the upper lip 14 of the collector 12. A volume of water 52 is collected in the collector 12. As the crest of the wave 50 passes and a trough 54 moves past the natural circulation apparatus 10, the volume of water 52 is conveyed from the top of the collector 12 through the outlet 16 of the lower end of the collector 12, because of the hydraulic pressure above the normal water surface elevation 56 from the volume of water 52. Although the circulation apparatus 10 is shown with the upper lip 14 extending above the normal water surface 56, the upper lip 14 may be submerged below the normal water surface 56.

There is a significant reduction in water resources and firm yield of reservoirs due to evaporation losses. Evaporation losses can amount to thirty to forty percent of firm yields of reservoirs. The natural circulation apparatus reduces evaporation from reservoirs by circulating the water and lowering the surface temperature. Installation of natural circulation apparatuses will be minimized to reduce objections of users of a reservoir. In addition, the upper lip 14 of the apparatus 10 will be located slightly above the water surface to minimize the objections of recreational users and interference with the aesthetics of the reservoir. The natural circulation apparatuses 10 are located throughout a reservoir 58 (see FIG. 7) to maximize the reduction of the surface water temperature and evaporation during warm weather months. During warm weather months, warmer water is located in the epilimnion of a reservoir, and colder water is located in the hypolimnion of a reservoir. The natural circulation apparatus has an additional benefit in that it should improve circulation and enhance water quality throughout a reservoir. The concentric tube with a larger diameter located above the water surface and smaller diameter tube located in the hypolimnion of the reservoir along with the energy of the waves will allow water to be effectively collected and circulated from the epilimnion to the hypolimnion. The apparatus should be clearly identified in a reservoir and/or designed of a material to reduce the likelihood of the apparatus becoming a navigational hazard.

The equation below provides a calculation of the daily evaporation rate in inches of depth based on the saturation vapor pressure at the water surface, vapor pressure of the air, and wind velocity at 25 feet above the water surface.

$$E=C(E_{ws}-E_a)(1-W/10)$$

Where E is the daily evaporation in inches of depth; $Ew_{ws}$ is the saturation vapor pressure at the water surface temperature in inches of Hg; $E_a$ is the vapor pressure of the air in inches of Hg; W is the wind velocity in mph measured about 25 feet above the water surface; and C is an empirical coefficient of 0.36.

For example, if the surface water temperature is 80° F., the air temperature is 90° F., the wind speed is 10 mph, and the relative humidity is 20 percent, the water evaporation rate may be calculated as follows:

$E_{ws}$ is 1.03 for water at 80° F. in inches of Hg.

$E_a$ is 1.42 for air at 90° F. multiplied by 0.20 for 20 percent humidity=0.28 inches of Hg.

Thus, $E$=0.36 (1.03−0.28)(1+10/10)=0.54 in/day.

If the surface water temperature is reduced to 60° F., and the other factors remain the same (i.e. air temperature remains at 90° F., wind speed and relative humidity are 10 mph and 20%, respectively), the water evaporation rate may be calculated as follows:

$E_{ws}$ is 0.52 inches of Hg for water at 60° F.

$E_a$ is 0.28 inches of Hg for air at 90° F. at 20 percent relative humidity.

$E$=0.36 (0.52−0.28)(1+10/10)=0.18 in/day.

Thus, based on the above the equations, reducing the surface water temperature by 20° F. results in a reduction of the evaporation rate by 67 percent.

With the installation of natural circulation apparatuses, water quality may be enhanced because the reservoir over time will become destratified. Dissolved oxygen levels will increase in the lower depths of the reservoir; thus, anaerobic, anoxic layer in the bottom of the lake will be minimized and will not encourage the growth of toxic anaerobic organisms.

The design of the natural circulation apparatus 10 captures the wave energy as the wave 50 submerges the upper opening 14 of the apparatus 10. Once the water volume 52 of a wave 50 is collected in the apparatus, there is a tendency of the water volume to be conveyed through the apparatus from top to bottom because of the additional hydraulic pressure above the normal water surface elevation 56 from the volume of water 52.

The apparatus 10 is structurally supported 24 from the bottom 60 of the reservoir 58 to locate the apparatus 10 at the appropriate water level above the epilimnion. The apparatus 10 includes adjustable extensions 24 to manually adjust the apparatus 10 with changes in the normal water surface levels and wave heights. The top 14 of the apparatus 10 may be automatically adjusted depending on wave conditions throughout a reservoir. The collector 12 extends into the lower depth of the reservoir to allow warmer water to be conveyed to the colder water of the reservoir 58. The design of the natural circulation apparatus 10 forces water to move from the warmer water to the colder water. As the waves 50 throughout a reservoir 58 submerge the natural circulation apparatus 10 and a volume of water 52 is collected in the apparatus 10, there will be a natural tendency for water to be conveyed 62 from the epilimnion to the hypolimnion. The volume of water captured 52 by the natural circulation apparatus 10 provides the pressure to force the warmer water to the lower depths of the reservoir. The check valve 20 installed at the bottom 16 of the apparatus 10 to minimize any oscillation effects between the epilimnion and hypolimnion.

The potential volume of water collected 52 by the natural circulation apparatus 10 is dependent on the height of the wave and wave length of the wave 50 and is calculated in the following equation:

$$V_1=A_T\times H$$

Where $V_1$ is the maximum potential volume of water collected through a natural circulation apparatus for a wave event; $A_T$ is the area of the top of a natural circulation apparatus; and H is the height of a natural circulation apparatus above the normal water level.

Thus, for a natural circulation apparatus with a diameter of 14 feet and a height above the normal surface of 3 inches, the volume collected is:

$$V_1=3.14(7)^2\times 3/12=38.5 \text{ cubic feet or } 288 \text{ gallons}$$

The natural circulation apparatus 10 is designed to be approximately three inches above the normal water level 56 to capture and collect water from the crest of the wave 50 that is above the normal water surface 56. The upper diameter of the circulation apparatus 10 is approximately fourteen feet for an area of approximately 154 square feet. The volume of water which may be collected by the natural circulation apparatus 10 is approximately 38.5 cubic feet or 288 gallons.

To have a significant impact in decreasing the surface water temperature, the spacing of two or more natural circulation apparatuses 10 throughout a reservoir 58 may be every 1,000 feet and the depth of water to be circulated is assumed to be at least six feet. The volume of water to be circulated in a reservoir by one natural circulation apparatus may be expressed by the following equation:

$$V_2=L_1\times L_2\times D_1$$

Where $V_2$ is the volume of water to be circulated in the reservoir for one natural circulation apparatus; $L_1$ is the length of the area for one natural circulation apparatus; $L_2$ is the width of the area; and $D_1$ is the depth of the area.

For an area of 1000 feet long by 1000 feet wide by 6 feet deep, $V_2$=1,000 feet×1,000 feet×6 feet=6,000,000 cubic feet or 45 million gallons (MG). Thus, the volume of water to be circulated in the reservoir for one natural circulation apparatus is 45 MG.

The natural circulation apparatus 10 is designed to minimize head losses through the natural circulation apparatus 10 and to allow the volume of water 52 to be conveyed from the crest of wave 50 to the bottom of the collector 16. The top diameter of the natural circulation apparatus 10 above the water surface 56 is significantly larger than the diameter of the bottom 16 of the natural circulation apparatus 10.

The pressure to move the water through the natural circulation apparatus 10 is based on the hydraulic head above the normal water level 56. There is a tendency for the volume of water 52 collected in the apparatus 10 to equalize with the normal water surface elevation 56 of the reservoir 58. Thus, water 64 is forced through the apparatus 62 by the hydraulic pressure of the wave.

The available head to convey the water through the natural circulation apparatus 10 is approximately three inches. The upper portion of the apparatus is 14 feet in diameter, the lower portion of the apparatus is two feet diameter, and the length of the apparatus may be 40 feet, for example depending on the depth of the reservoir. A 24-inch check valve is mounted vertically; thus, the check valve will be normally open to allow water to flow from the epilimnion to hypolimnion. The check valve closes if flow occurs from the hypolimnion to the epilimnion. The check valve 18 may be constructed of a lightweight material to be sensitive to any changes in flow direction or louver type design.

Once the apparatus is full of water but there is still no movement of water through the apparatus and the water level inside the apparatus and outside the apparatus are at the same level, the following conservation of energy equation applies:

$$Z_1+\Delta Z_1=P_2/\gamma+\Delta P_2/\gamma$$

Where $Z_1$ is the elevation distance from the datum to the normal water level; $\Delta Z_1$ is the elevation distance from the normal water level to the top of the apparatus or Location 1; $P_2/\gamma$ is the pressure head from the datum or Location 2 to the normal water level; $\Delta P_2/\gamma$ is the pressure head from the normal water level to the top of the apparatus or water level outside the apparatus; Location 1 is at the water surface inside the apparatus; and Location 2 is at the bottom of the apparatus.

As the water surface outside the apparatus begins to equalize with the normal water level and $\Delta P_2/\gamma$ goes to zero outside the apparatus, $\Delta P_2/\gamma$ inside the apparatus will convert to a velocity head plus friction and minor head losses and pressure change due to specific weight differences between water inside the apparatus and water outside the apparatus. The apparatus will begin to drain slowly expressed by the following equation written for the conservation of energy for water inside the apparatus.

$$Z_1+\Delta Z_1=P_2/\gamma+V_2^2/2g+\text{Friction and Minor Head losses}+\Delta\text{ Specific Weight Pressure}$$

Where $Z_1$ is the elevation distance from the datum to the normal water level; $\Delta Z_1$ is the elevation distance from the normal water level to the top of the apparatus or Location 1, typically $\Delta Z_1$ is three inches to convey the maximum instantaneous flow rate through the apparatus; $P_2/\gamma$ is the pressure head from the datum or Location 2 to the normal water level; $V_2^2/2$ g=Velocity head above the normal water surface for Location 2; Head losses are friction and minor losses; and Δ Specific Weight Pressure is the maximum pressure change due to the difference in specific weight inside the apparatus in respect to the average specific weight outside the apparatus. The velocity head for Location 1 is negligible since the upper opening is very large and is not included in the below equation.

$$40\text{ feet}+0.25\text{ feet}=40\text{ feet}+V_2^2/2g+\text{Exit Loss}+\text{Friction Loss}+\text{Gradual Contraction Losses}+\text{Check Valve Losses}+\Delta\text{ Specific Weight Pressure}$$

$$40+0.25=40+V_2^2/2g+1.0V_2^2/2g+0.001+0.48\,V_2^2/2g+0.72V_2^2/2g+0.096\text{ feet}$$

$$0.15=3.2V_2^2/2g+0.001\text{ or}$$

$$0.15=3.2(Q/A_2)^2/2g$$

$$A2=3.14\text{ square feet for a 24-inch diameter pipe}$$

$$0.15=3.2(Q/3.14)^2/2g$$

$$Q=Q_1=Q_2$$

Solving for Q, the maximum instantaneous flow rate=Q=5.5 cfs or 2,481 gpm.

Velocity through 24-inch diameter pipe is 1.8 fps.

Friction and minor head losses are summarized below:

Exit loss for 24-inch diameter pipe=$KV^2/2g$ where K is 1.0

Friction loss for average diameter of 96 inches at 2,481 gpm=0.001 feet

Gradual contractions losses for theta greater than 45 degrees and less than 180 degrees. For theta greater than 45 degrees and less than 180 degrees, $K=0.5(1-d_1^2/d_2^2)(\sin \text{theta}/2)^{0.5}$. Theta is 163 degrees for 168-inch and 24-inch diameter pipes.

Gradual contraction losses where K is $0.5(1-24^2/168^2)(\sin 163/2)^{0.5}=0.48$ 24-inch diameter check valve loss=$KV^2/2g$ where K is 0.72. This is an assumed conservative value and will introduce more head loss into the equation than anticipated because the check valve will be normally open and no pressure is required to open the check valve.

Δ specific weight pressure is summarized below:

Maximum pressure change is due to the difference in specific weight that occurs when the specific weight is at a temperature of 80° F. inside the apparatus to an average of 60° F. outside the apparatus in the water column, that is, 62.22 lbs/cubic foot and 62.37 lbs/cubic foot, respectively.

Water temperature inside the apparatus is at 80° F.

Specific weight is 62.22 lbs/cubic feet at 80° F.

Average temperature in the water column outside the apparatus is at 60° F.

Average specific weight in the water column is 62.37 lbs/cubic foot at 60° F.

(62.37 lbs/cubic foot−62.22 lbs/cubic foot)×40 feet×$ft^2$/144 $in^2$=0.0416 psi Liquid pressure change in feet=(0.0416 psi×144)/(62.37+62.22)/2=0.096 feet or 1.16 inches Maximum instantaneous flow rate through the natural circulation apparatus is 2,481 gpm.

The apparatus will ultimately drain to an elevation that will overcome the difference in specific weight pressure between the temperature of water inside the apparatus and the temperature outside the apparatus plus friction and minor head losses and velocity head. For this example, the temperature inside the apparatus is 80° F. and the average temperature outside the apparatus in the water column is 60° F. The lowest elevation the apparatus will drain to is approximately 1.3 inches above the normal water surface and this elevation corresponds to the minimum instantaneous flow rate. The following conservation of energy equation is written for the minimum instantaneous flow rate.

$$Z_1+\Delta Z_1=P_2/\gamma+V_2^2/2g+\text{Friction and Minor Head losses}+\Delta\text{ Specific Weight Pressure}$$

$Z_1$=Elevation distance from the datum to the normal water level.

$\Delta Z_1$=Elevation distance from the normal water level to the top of the apparatus or Location 1. $\Delta Z_1$ is 1.3 inches to convey the minimum instantaneous flow rate through the apparatus.

$P_2/\gamma$=Pressure head from the datum or Location 2 to the normal water level.

$V_2^2/2g$=Velocity head above the normal water surface.

Headlosses=Friction and minor losses.

Δ Specific Weight Pressure=Maximum pressure change due to the difference in specific weight inside the apparatus in respect to the average specific weight outside the apparatus. Location 1 is at the water surface inside the apparatus. Location 2 is at the bottom of the apparatus. The velocity head for Location 1 is negligible since the upper opening is very large and is not included in the equation.

$$40\text{ feet}+0.11\text{ feet}=40\text{ feet}+V_2^2/2g+\text{Exit Loss}+\text{Friction Loss}+\text{Gradual Contraction Losses}+\text{Check Valve Losses}+\Delta\text{ Specific Weight Pressure}$$

$$40+0.11=40+V_2^2/2g+1.0V_2^2/2g+0.001+0.48V_2^2/2g+0.72V_2^2/2g+0.096\text{ feet}$$

$$0.01=3.2V_2^2/2g+0.001\text{ or}$$

$$0.01=3.2(Q/A_2)^2/2g$$

$$A2=3.14\text{ square feet for a 24-inch diameter pipe}$$

$$0.15=3.2(Q/3.14)^2/2g$$

$$Q=Q_3=Q_4$$

Solving for Q the Minimum Instantaneous Flow rate=Q=1.6 cfs or 702 gpm.

Velocity through 24-inch diameter pipe is 0.6 fps.

Friction and minor head losses are summarized below:

Exit Loss for 24-Inch Diameter Pipe=$KV^2/2g$ where K is 1.0

Friction Loss for Average Diameter of 96-Inches at 702 gpm=0.001 feet

For gradual contractions losses for theta greater than 45 degrees and less than 180 degrees, $K=0.5(1-d_1^2/d_2^2)(\sin \text{theta}/2)^{0.5}$. Theta is 163 degrees for 168-inch and 24-inch diameter pipes.

Gradual contraction losses where K is $0.5(1-24^2/168^2)(\sin 163/2)^{0.5}=0.48$ 24-Inch Diameter Check Valve Loss=$KV^2/2g$ where K is 0.72. This is an assumed conservative value and will introduce more head loss into the equation than anticipated because the check valve will be normally open and no pressure is required to open the check valve.

The Δ specific weight pressure is determined based on the maximum pressure change due to the difference in specific weight that occurs when the specific weight is at a temperature of 80° F. inside the apparatus to an average of 60° F. outside the apparatus in the water column, that is, 62.22 lbs/cubic foot to 62.37 lbs/cubic foot, respectively. The water temperature inside the apparatus is at 80° F. The specific weight is 62.22 lbs/cubic feet at 80° F. The average temperature in the water column outside the apparatus is at 60° F. The average specific weight in the water column is 62.37 lbs/cubic foot at 60° F.

$$(62.37\ \text{lbs/ft}^3-62.22\ \text{lbs/ft}^3)\times 40\ \text{ft}\times\text{ft}^2/144\ \text{in}^2=0.0416\ \text{psi}$$

Liquid pressure change in feet=(0.0416 psi×144)/(62.37+62.22)/2=0.096 ft or 1.16 in.

Thus, the minimum instantaneous flow rate through the natural circulation apparatus is 702 gpm.

Summary of Water Elevations in the Apparatus Versus Flow Rates

| Water Elevation in Apparatus (Inches) | Flow Rate (gpm) |
|---|---|
| 3.0 | 2,481 - Maximum flow rate |
| 2.6 | 2,196 |
| 2.15 | 1,823 |
| 1.7 | 1,351 |
| 1.3 | 702 - Minimum flow rate |
| | ΣQ 8,553 gpm |

The water elevation corresponds to the water surface elevation inside the apparatus.

The maximum time required to drain the natural circulation apparatus for one wave cycle may be represented by the following equation:

$$T_1=V_1/(\Sigma Q)/5$$

Where $T_1$ is the maximum amount of time to drain the natural circulation apparatus for one wave event; and ΣQ is the summation of five flow rates at various water surface elevations in the apparatus to provide a discharge profile.

$$T_1=288\ \text{gallons}/(8{,}553\ \text{gpm})/5=0.17\ \text{minutes or 10 seconds}$$

Thus, the maximum time required to drain the natural circulation apparatus is approximately 10 seconds.

The average flow rate through the natural circulation apparatus may be determined by the following equation:

$$Q_5=\Sigma Q/5\times\text{Efficiency}$$

Where $Q_5$ is the average flow rate through natural circulation apparatus based on an available head range of three inches to 1.3 inches. This corrected available head range is based on considering maximum change in specific weight pressure of the water inside the apparatus and outside the apparatus of 0.096 feet; ΣQ is the summation of five flow rates at various water surface elevations in the apparatus to provide a discharge profile; Efficiency is the amount of time the apparatus is filling and draining in percent.

$$Q_5=(8{,}553\ \text{gpm})/5=1{,}710\ \text{gpm}$$

Assuming the natural circulation apparatus fills and drains 30 percent of the time or the efficiency is 30 percent.

$$1{,}710\ \text{gpm}\times 0.30=513\ \text{gpm}$$

Thus, the average flow rate through the natural circulation apparatus is 513 gpm.

The time required to circulate the water in the reservoir may be calculated as follows:

$$T_2=V_2/Q_5$$

Where $T_2$ is the time required to circulate water in reservoir; $V_2$ is the volume of water to be circulated for one natural circulation apparatus; and $Q_5$ is the average flow rate through natural circulation apparatus.

$$T_2=V_2/Q_5=45\ \text{MG}/513\ \text{gpm}=87{,}719\ \text{minutes or 61 days}$$

Accordingly, the time required to naturally circulate water through a reservoir is 61 days.

The natural circulation apparatus will be designed to remain in a permanent location to capture the wave and wind energy through out a reservoir. The foundation of the natural circulation apparatus will be designed to minimize settlement and deflection of the apparatus.

Figure 7:
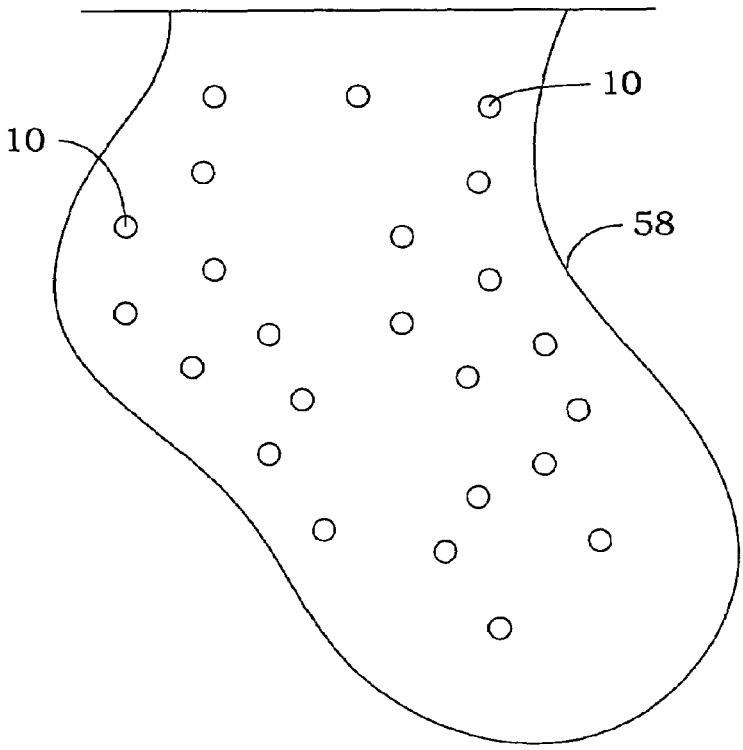
FIG. 7 is a plan view of a reservoir with a plurality of natural circulation apparatuses.

The location of the natural circulation apparatuses will be throughout a reservoir to maximize the reduction of surface water temperature and reduction of evaporation. FIG. 7 depicts or represents the location of natural circulation apparatuses through out a reservoir.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A natural water circulation apparatus for use in a water reservoir having:

a frustro-conical collector having an upper opening and a lower opening; said upper opening having a cross-sectional area greater than a cross-sectional area of said lower opening;

a support for anchoring said collector to the bottom of the reservoir and for securing said collector wherein said upper opening is above a normal surface level of the reservoir;

wherein surface waves on the reservoir flow over said upper opening of said collector and are capture by said collector creating a hydraulic head pressure within said collector; and wherein the captured surface waves are conveyed from said upper opening of said collector to said lower opening by said hydraulic head pressure.

2. The natural water circulation apparatus as set forth in claim 1 further comprising a check valve secured to said lower opening of said collector to prevent water from flowing from said lower opening toward said upper opening within said collector.

3. The natural water circulation apparatus as set forth in claim 2 wherein said check valve is normally open.

4. The natural water circulation apparatus as set forth in claim 2 wherein said check valve is normally closed.

5. The natural water circulation apparatus set forth in claim 1 further comprising a flange secured around a periphery of said upper opening of said collector.

6. The natural water circulation apparatus as set forth in claim 5 wherein said flange is generally S-shaped.

7. The natural water circulation apparatus as set forth in claim 1 wherein the height of the upper opening is manually adjustable.

8. The natural water circulation apparatus as set forth in claim 1 wherein the height of the upper opening is automatically adjustable to the normal surface level of the reservoir.

9. The natural water circulation apparatus as set forth in claim 1 wherein a plurality of said natural water circulation apparatuses are anchored in the water reservoir.

10. The natural water circulation apparatus as set forth in claim 1 wherein said upper opening of said collector is positioned above the normal surface level of the reservoir.

11. The natural water circulation apparatus as set forth in claim 1 wherein said upper opening of said collector is positioned below the normal surface level of the reservoir.

12. A water circulation apparatus for use in a body of water comprising:

a collector having an upper opening and a lower opening;

a support for anchoring said collector to the bottom of the body of water, said upper opening extending above a normal surface level of the body of water, wherein waves on the surface of the body of water flow over said upper opening and are captured by said collector creating a hydraulic head pressure within said collector, and wherein the captured waves are conveyed from said upper opening to said lower opening of said collector by said hydraulic head pressure.

13. The water circulation apparatus as claimed in claim 12 wherein said collector is generally frustro-conically shaped.

14. The water circulation apparatus as claimed in claim 12 wherein said upper opening has an area greater than an area of said lower opening.

15. The water circulation apparatus as claimed in claim 12 further comprising a check valve secured to said lower opening of said collector to prevent water from flowing from said lower opening toward said upper opening within said collector.

16. The water circulation apparatus as set forth in claim 15 wherein said check valve is normally open.

17. The water circulation apparatus as set forth in claim 15 wherein said check valve is normally closed.

18. The water circulation apparatus set forth in claim 12 further comprising a flange secured around a periphery of said upper opening of said collector.

19. The water circulation apparatus as set forth in claim 18 wherein said flange is generally S-shaped.

20. The water circulation apparatus as set forth in claim 12 wherein the height of the upper opening is manually adjustable.

21. The water circulation apparatus as set forth in claim 12 wherein the height of the upper opening is automatically adjustable to the normal surface level of the reservoir.

22. The water circulation apparatus as set forth in claim 12 wherein a plurality of said water circulation apparatuses are positioned and spaced apart within said body of water.

23. The water circulation apparatus as set forth in claim 12 wherein said upper opening of said collector is positioned above the normal surface level of the reservoir.

24. The water circulation apparatus as set forth in claim 12 wherein said upper opening of said collector is positioned below the normal surface level of the reservoir.

* * * * *